United States Patent [19]

Ritter et al.

[11] Patent Number: 4,766,820

[45] Date of Patent: Aug. 30, 1988

[54] HOPPER CAR WITH AUTOMATIC DISCHARGE DOOR MECHANISM

[75] Inventors: John A. Ritter, Cincinnati, Ohio; Keith J. Hallam, Roswell, Ga.

[73] Assignee: Thrall Car Manufacturing Company, Chicago Heights, Ill.

[21] Appl. No.: 57,111

[22] Filed: Jun. 3, 1987

[51] Int. Cl.[4] ..... B61D 7/26

[52] U.S. Cl. ..... 105/240; 105/253; 105/290; 105/311.2; 105/313; 298/30

[58] Field of Search ..... 105/287, 290, 304, 311.2, 105/240, 248, 253, 310, 313; 298/30

[56] References Cited

U.S. PATENT DOCUMENTS

| | | | |
|---|---|---|---|
| 3,161,146 | 12/1964 | Lutts, Sr. et al. | 105/240 |
| 3,187,684 | 6/1965 | Ortner | 105/248 |
| 3,391,653 | 7/1968 | De Ridder | 105/253 |
| 3,596,608 | 8/1971 | Aquino et al. | 105/251 |
| 3,596,609 | 8/1971 | Ortner | 105/240 |
| 3,710,729 | 1/1973 | Schuller | 105/240 |
| 3,815,514 | 5/1974 | Heap | 105/304 X |
| 4,132,177 | 1/1979 | Funk | 105/310 |
| 4,601,244 | 7/1986 | Fischer | 105/240 |
| 4,688,488 | 8/1987 | Adams et al. | 105/253 |

*Primary Examiner*—Robert B. Reeves
*Assistant Examiner*—Frank H. Williams, Jr.
*Attorney, Agent, or Firm*—Marshall, O'Toole, Gerstein, Murray & Bicknell

[57] ABSTRACT

A railroad hopper car having bottom discharge doors, an elongated beam assembly along the bottom of the car, door operating levers to open and close the doors connected to the beam assembly and doors, and lost motion connections in the beam assembly which permit displacement of beam sections to open and close pairs of doors in a sequential but substantially simultaneous and automatic order, and a pneumatic drive to move the beam in opposite directions to open and close the doors.

15 Claims, 7 Drawing Sheets

HOPPER CAR WITH AUTOMATIC DISCHARGE DOOR MECHANISM

This invention relates to railroad hopper cars which carry aggregate lading, such as coal, stone and ores, which is unloaded by gravity flow through doors or gates in the bottom of the car body. More particularly, this invention is concerned with apparatus for the simultaneous quick opening and closing of the hopper car doors and a secondary lock mechanism which prevents the doors from opening accidentally.

BACKGROUND OF THE INVENTION

Railroads carry large amounts of aggregate lading such as coal, stone, ores and the like in open top hopper cars having gravity discharge openings in the car body bottom which are closed by openable doors or gates. Such doors were originally opened manually but, to reduce costs and speed lading discharge, various systems were developed to open the doors by mechanical means of different types. These discharge systems usually required that the car be stationary before the doors were opened. While such systems are highly useful for many shippers, they are still undesirably slow for unloading unit trains, such as trains of one hundred coal-loaded hopper cars. The unloading of trains of that magnitude is best effected by discharging the lading by opening the doors of a car in car-by-car sequence as the train continuously moves past the unloading site. The unloading of hopper cars in this manner requires that the door operating mechanism be safe and reliable and respond quickly to suitable signals to which the door operating mechanism responds. To prevent the door operating mechanism from opening accidentally a secondary lock is generally included. Such secondary locks are disclosed in U.S. Pat. Nos. 3,710,729 and 4,132,177. Also, U.S. Pat. Nos. 3,596,608 and 3,596,609 disclose door-actuating mechanisms.

Although the previously available apparatus for operating the hopper doors is useful for the intended purpose, alternative apparatus which operates the doors quickly and reliably and provides easy adjustment so that all doors can be tightly closed is desirable, as well as an improved secondary lock mechanism.

SUMMARY OF THE INVENTION

According to the invention a railroad hopper car is provided comprising an elongated car body having a plurality of laterally pivoted bottom discharge doors; a door opening and closing elongated beam assembly positioned longitudinal of and along the bottom portion of the car; a plurality of spaced apart door operating levers mounted on pivot means lateral to the car body along and to the bottom of the car; each door operating lever having at least first and second outwardly extending arm portions; a bar link pivotally connected at a first end to each door operating lever first arm portion and pivotally connected at a second end to one of the doors; the second arm portion of each door operating lever being pivotally connected to the elongated beam assembly; the second arm portions of the various levers being pivotally connected to the elongated beam assembly in spaced apart consecutive arrangement thereby defining beam sections between such pivotally connected lever arm portions; each beam section including a longitudinal lost motion means which permits displacement of the beam section for a short distance before it can apply a force in either direction to an adjacent beam section so that it can thereby apply sequential movement and force in one direction in tension and in the opposite direction in compression; and power means mounted on the car to drive the elongated beam in longitudinally opposite directions.

Each beam assembly section is desirably provided with means to change its length separate from the lost motion means.

Each bar link can include means to change its length so that the door to which it is connected can be adjusted to be closed tightly.

When the door is closed the bar link first end pivotal connection to the operating lever first arm desirably is at an over-center position with respect to a line through the pivotal connection of the bar link second end to the door and the pivotal connection of the lever arm to the car body thereby preventing the door from opening without a dynamic force being applied by the operating lever.

A plurality of the door operating levers can have a third outwardly extending arm; and a second bar link can be pivotally connected at a first end to the third arm portion and pivotally connected at a second end to one of the doors.

When the door is closed the second bar link first end pivotal connection to the operating lever third arm desirably is at an over-center position with respect to a line through the pivotal connection of the second bar link second end to the door and the pivotal connection of the lever arm to the car body thereby preventing the door from opening without a dynamic force being applied by the operating lever.

The means to change the length of a plurality of beam sections can include a clevis threaded into each of a plurality of the beam sections.

The means to change the length of a plurality of bar links can include a clevis threaded into each of a plurality of the bar links.

The lost motion means can include a pin in one portion of the beam section and a slot in an adjoining beam portion in which the pin can slide a short distance.

Means to drive the beam in opposite directions to fully open and fully close all of the doors substantially simultaneously is also included. The drive means can include an air cylinder mounted on the car body; a double acting piston in the air cylinder having a connecting rod extending out of the cylinder; a drive lever pivotally mounted at the bottom of the car body; and a first end of the drive lever being pivotally connected to the connecting rod and a second end of the drive lever being pivotally connected to the elongated beam.

The car can include a secondary lock having a hook means pivotally mounted to the first end of the drive lever and having a hook at an end facing the air cylinder; and a hook catch on the cylinder lockably engageable with the hook when the elongated beam is displaced so the doors are closed.

Disengaging means can also be provided on the hook means and connecting rod to disengage the hook from the latch upon movement of the connecting rod outwardly from the cylinder before the drive lever moves. The disengaging means can include a cam and follower roller combination which lifts the hook out of locking engagement with the hook catch.

The connecting rod exterior of the cylinder can include a lost motion means whereby displacement of the connecting rod outwardly of the cylinder disengages the hook from the catch before applying driving force to the drive lever to move the beam to open the doors.

DETAILED DESCRIPTION OF THE DRAWINGS

To the extent it is reasonable and practical the same or similar elements which appear in the various views of the drawings will be identified by the same numbers.

Figure 1:
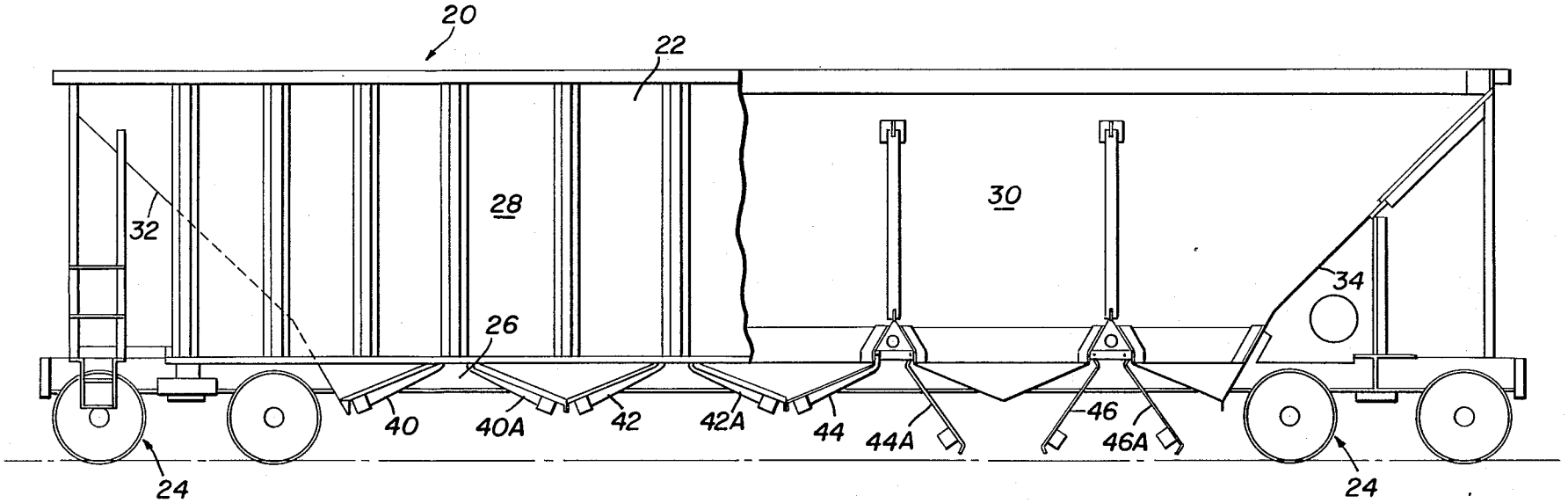
FIG. 1 is a side elevational view of a railroad car according to the invention having bottom discharge doors.

With reference to FIG. 1, the railroad car 20 has a body 22 supported at each end by conventional four wheel two axle trucks 24. The car body is supported by a center sill 26 which is supported at each end by one of the car trucks. The car body has opposing substantially vertical side walls 28,30 and sloping ends 32,34. The car is intended to transport coal and similar aggregate materials which can be readily and quickly emptied by gravity flow through bottom discharge openings having pivotal doors or gates located along the bottom of the car body.

The car 20, as shown in FIG. 1, has four pair of doors 40,40A; 42,42A; 44,44A and 46,46A. Each door is connected to the car body by a horizontal pivot pin or hinge 48 positioned to be substantially lateral to the car body and center sill 26. It is intended that the two doors of each pair operate in unison but rotate in opposite directions when being opened and in opposite directions when being closed. Additionally, for rapid discharge of the car lading, all doors are intended to be fully opened substantially simultaneously, and also subsequently fully closed substantially simultaneously. Accordingly, the car is illustrated in FIG. 1 with some doors closed and some doors open primarily to show the positions which the doors take with respect to the car body when opened and closed.

Figure 2:
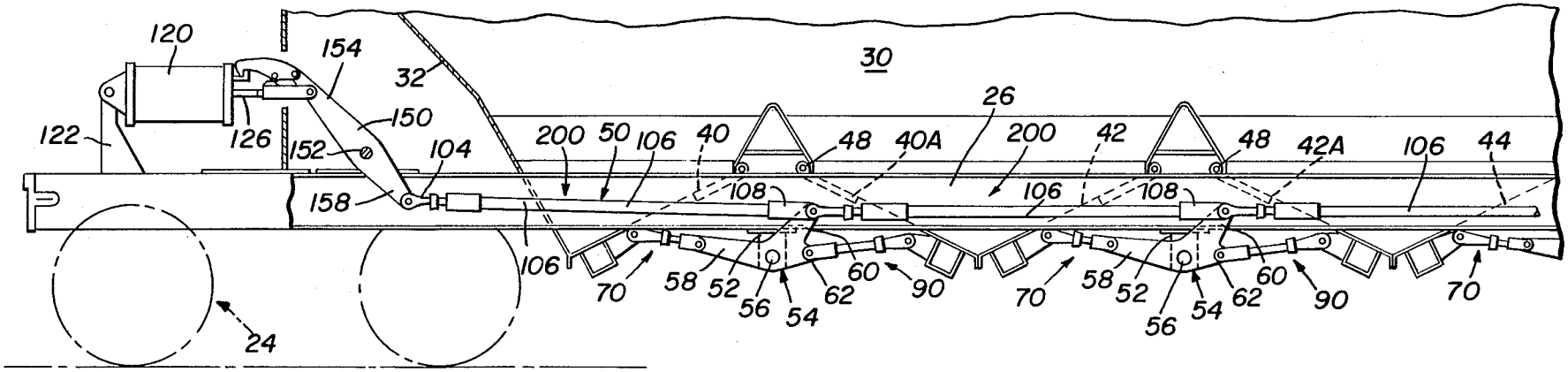
FIG. 2 is a side elevational view of the lower end portion of the railroad car shown in FIG. 1 with the side structure removed to expose the door operating mechanism.

Positioned in center sill 26 is a door opening and closing elongated beam assembly 50 (FIG. 2). Located in the center sill 26 are four longitudinally spaced apart door operating lever supports 52. A door operating lever 54 is pivotally mounted to each support 52 by a horizcntal shaft 56 which is positioned lateral to the center sill 26.

Figure 5:
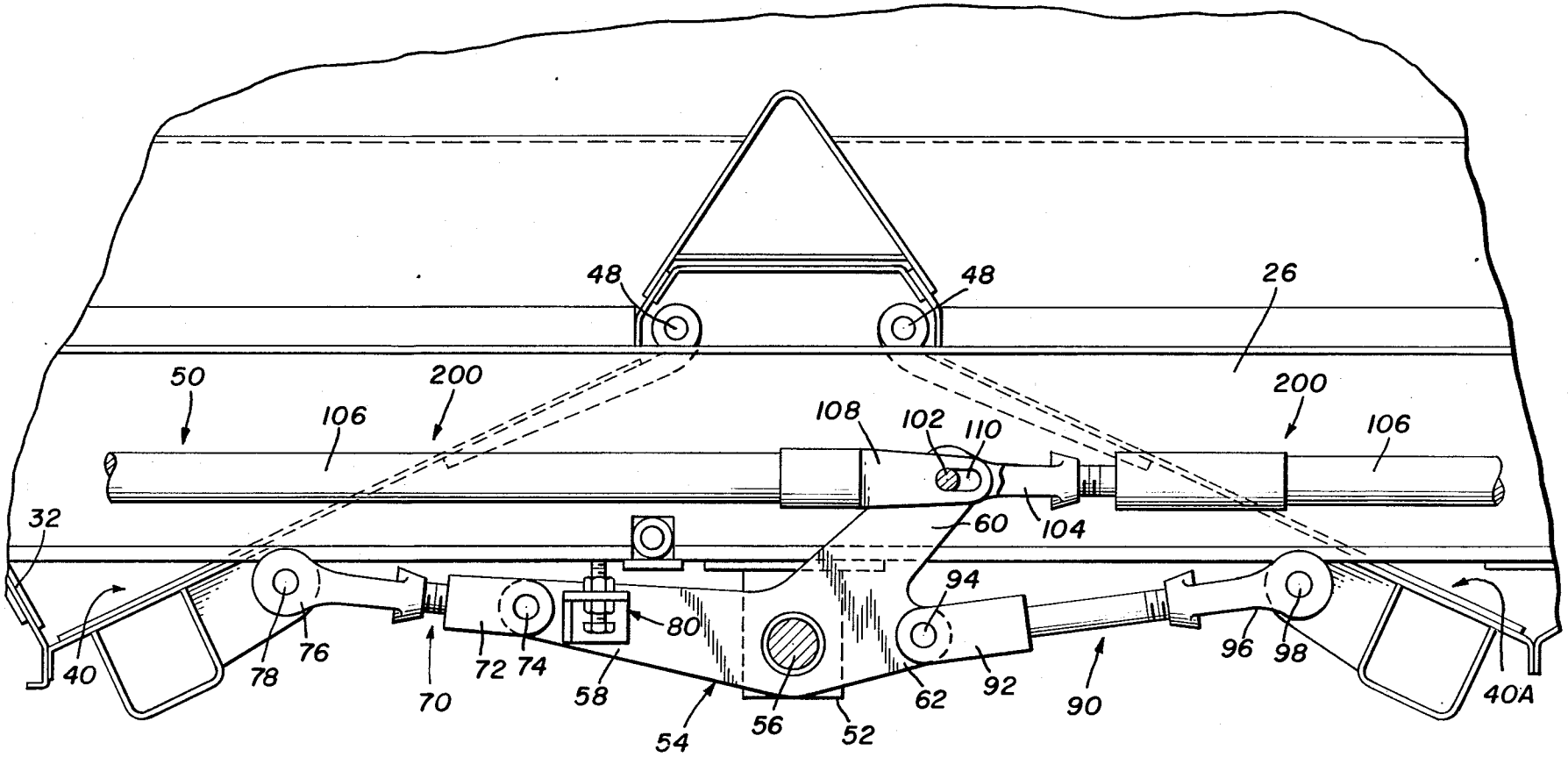
FIG. 5 is a side elevational view of a door operating lever showing it connected to two doors by bar links and to the elongated beam assembly.
Figure 6:
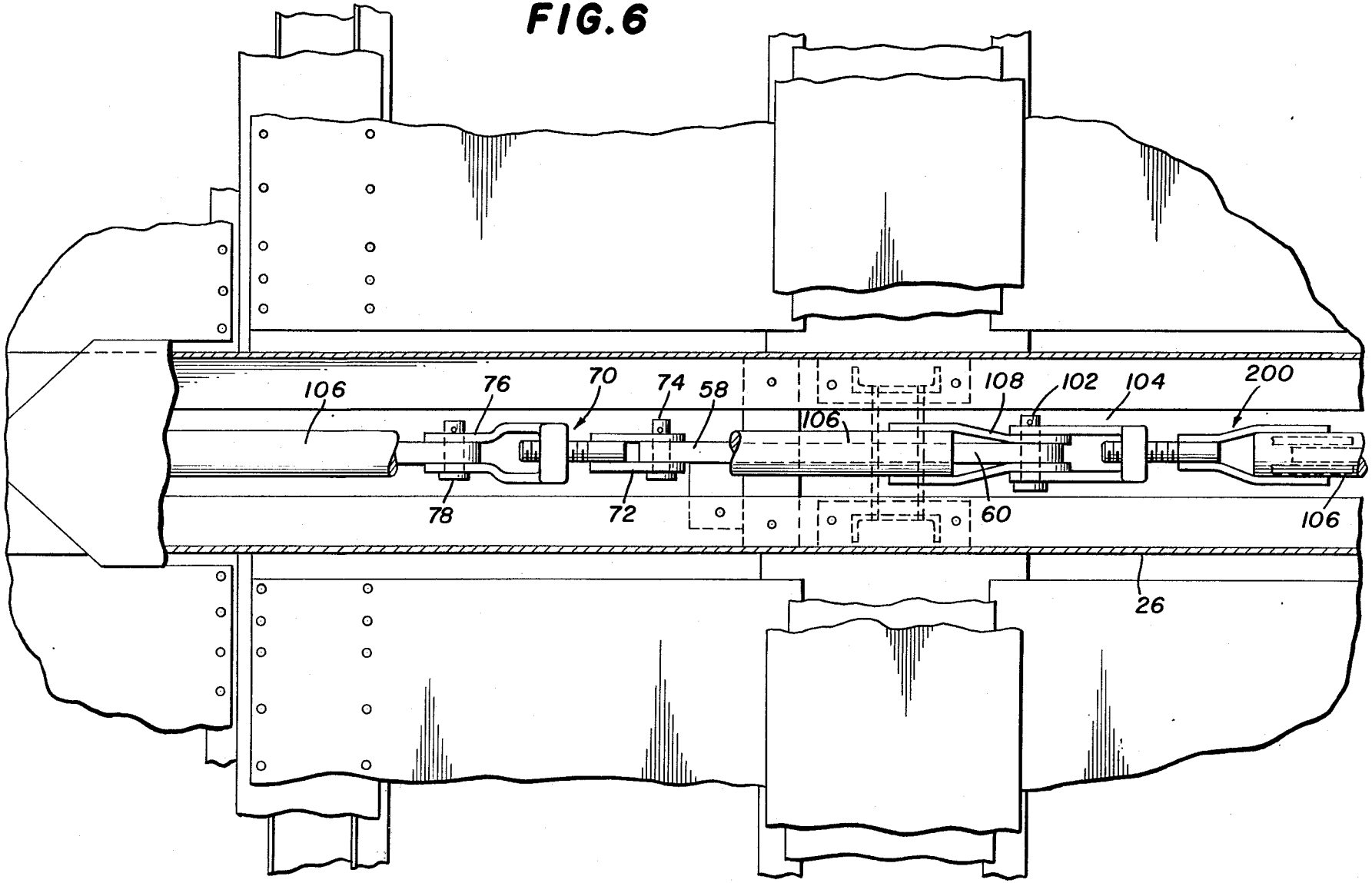
FIG. 6 is a plan view of the door operating elements illustrated by FIG. 5.

Each door operating lever 54 has a first are 58, a second arm 60 and a third arm 62 (FIG. 5). A first bar link 70 is pivotally connected at a first end 72 to the door operating lever first arm 58 by pin 74, and at a second end 76 to a door 40, 42, 44 or 46 by pin 78. The length of bar link 70 is adjusted or changed by rotating end 76, which constitutes a clevis which is threadably included as part of the first bar link. In this way, the door 40 can be adjusted to be tightly closed to keep lading from flowing out. When the door 40 is properly closed, as well as doors 42, 44, 46, the pin 74 is located over-center or above a line through pins 56,78. The amount of over-center displacement is limited by adjustable stop 80 (FIG. 5). The described over-center arrangement prevents the pressure of the lading on the door 40, as well as doors 42, 44, 46, from rotating door operating lever 54 and thereby causing the door 40, and all the other doors, from opening.

A second bar link 90 is pivotally connected at a first end 92 by pin 94 to the door operating lever third arm 62, and at a second end 96 by pin 98 to a door 40A, 42A, 44A or 46A. The length of bar link 90 is adjusted or changed by rotating end 96, which constitutes a clevis which is threadably included as part of the second bar link 90.

The second arm 60 of each door operating lever 54 is pivotally connected to the elongated beam assembly 56 by a pin 102. The beam assembly 56 is made up of four beam sections 200 which are of similar construction although not of identical length. One beam section 200 extends from drive lever 150 to the second arm of the first door operating lever 54 to which it is connected by a pin 102 while each of the other three beam sections 200 extend between the second arms of adjacent levers 54 and are connected thereto by pins 102.

Each beam section 200, when viewed from left to right, has a clevis 104 threadably and thereby adjustably connected to the first or left end of bar 106. The length of the bar section is readily changed by this threadable connection. The second or right end of bar 106 has a shackle 108 with opposing slots 110 (FIG. 5) in which pin 102 fits so that relative sliding motion between the two is permitted for a short distance thereby providing a lost motion connection between the beam section, door operating arm 60 and the next adjacent beam section. Pin 102, however, fits snugly in holes in the arm 60 and clevis 104.

The purpose of the lost motion connections is to permit each pair of doors to begin to open before the next pair of doors in sequence begins to open to thereby apply maximum force to initial opening of each pair of doors rather than to have the maximum force applied divided equally to all door operating levers. The force of the unloading lading on a pair of doors will transmit a force to the elongated beam thereby assisting the force requirements to move the next door operating lever over center to open. The lost motion connections provide a similar advantage when the door closing motion starts. At the end of the closing cycle, each pin will be at the left end of the slot. Therefore all door operating levers 54 will go over center and lock simultaneously.

As shown in FIGS. 3 to 7, air cylinder 120 is pivotally supported by bracket 122, mounted on the center sill 26, to rotate vertically about horizontal pin 124. A double acting piston, not shown, is positioned in air cylinder 120. Connecting rod 126 is connected to the piston and extends out of the end of the air cylinder 120. A clevis 128 is threadably connected to the end of connecting rod 126. The clevis 128 has a pair of opposing slots 130.

Figure 3:
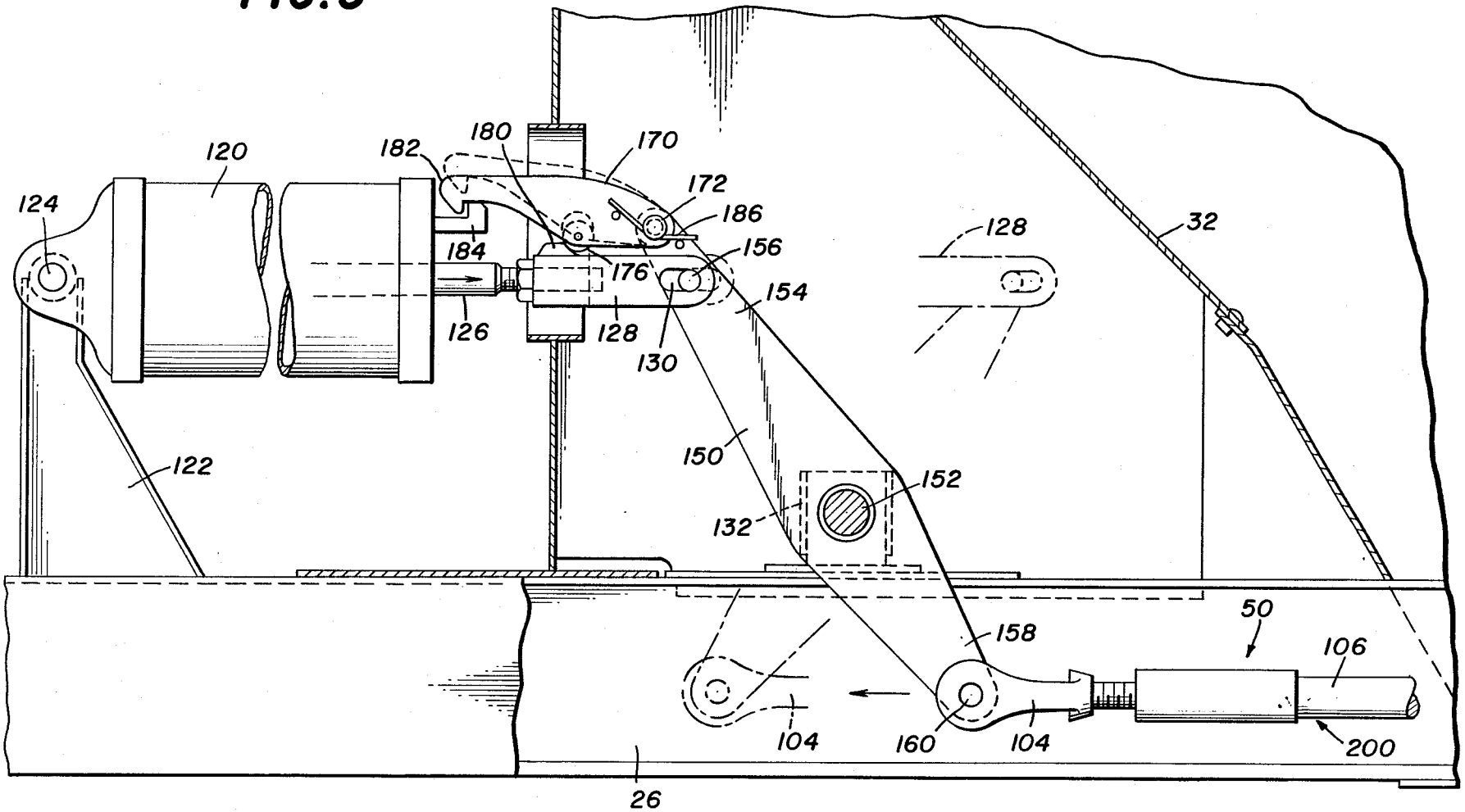
FIG. 3 is a side elevational view of the end of the railroad car shown in FIG. 2 showing the air cylinder and drive lever enlarged, and in position with the doors closed.
Figure 4:
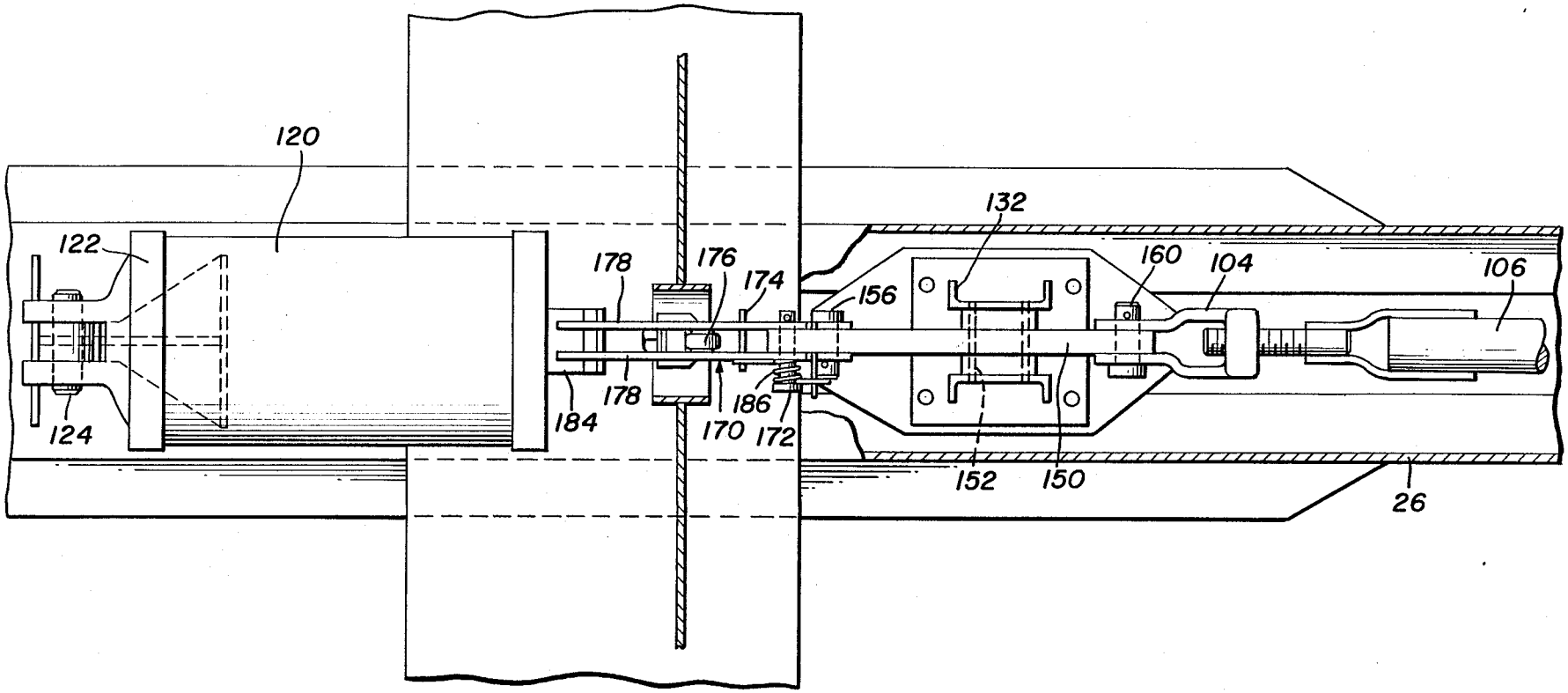
FIG. 4 is a plan view of the air cylinder and drive lever arrangement shown in FIG. 3.
Figure 7:
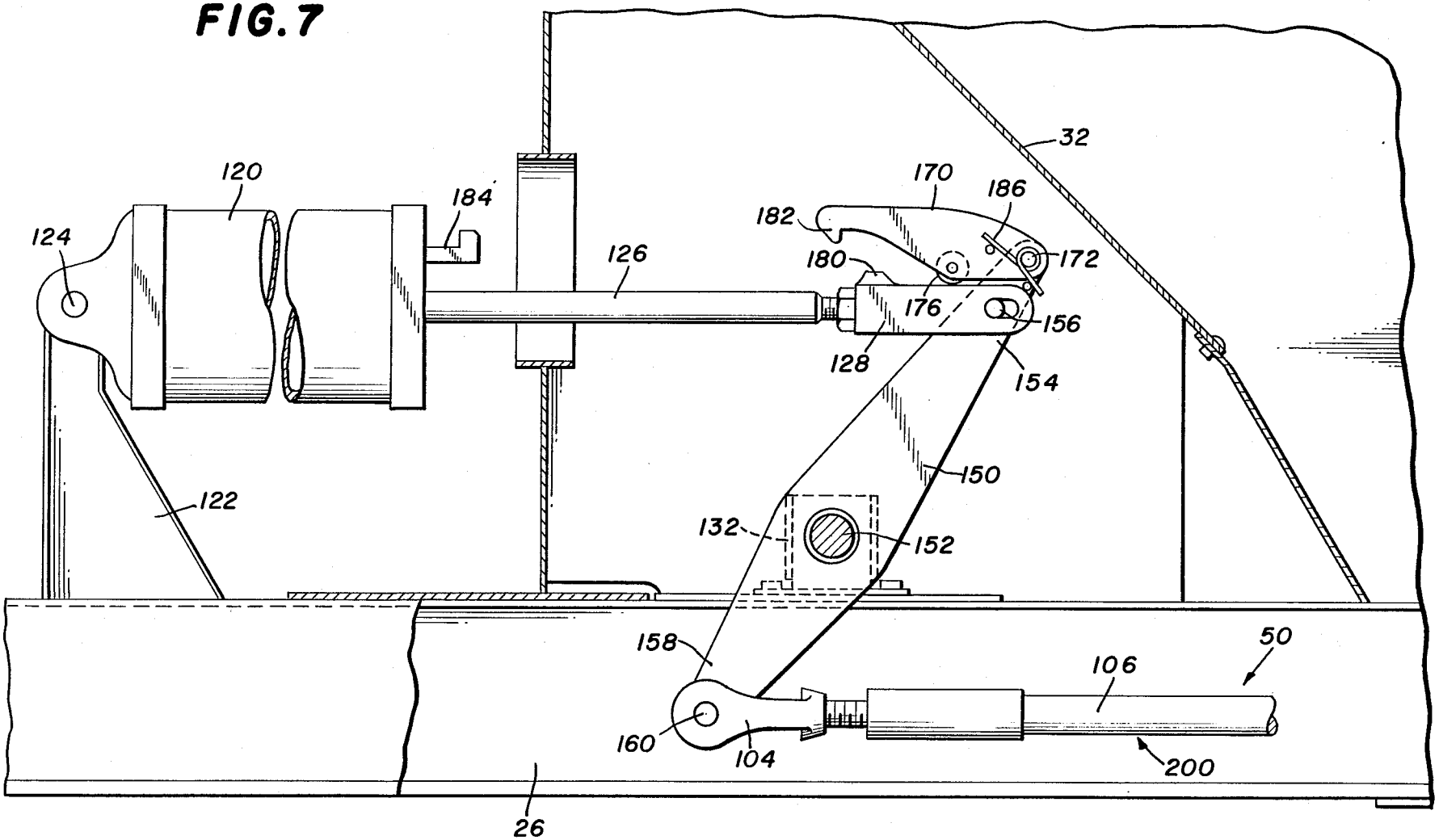
FIG. 7 is a side elevational view similar to FIG. 3 but illustrating the position taken by the drive lever when the doors are open.
Figure 8:
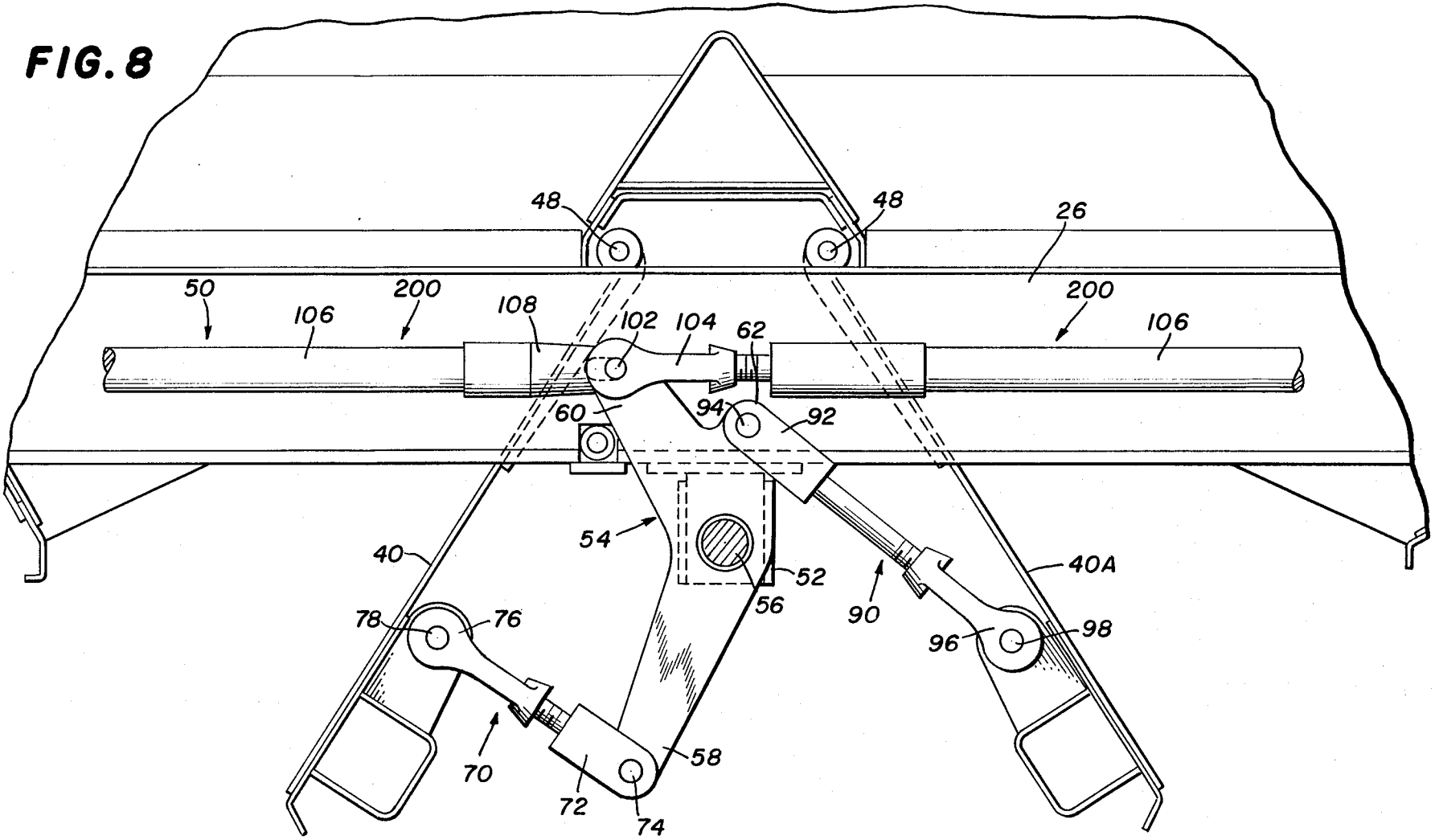
FIG. 8 is a side elevational view similar to FIG. 5 but with the doors opened by the door opening lever.

A bracket 132 is mounted on center sill 26 and pivotally supports drive lever 150 by means of horizontally and laterally positioned pin 152. The first or upper end of the drive lever 150 is connected to the clevis 128 by pin 159 which fits in slots 130 thereby providing a lost motion connection by which the connecting rod moves a short distance before it applies a driving force to the drive lever 150. The second or lower end 158 of drive lever 150 is connected to clevis 104 at the left end of beam assembly 50 by a laterally positioned horizontal pin 160. FIG. 3 illustrates the position of the drive lever 150 with the doors in closed position while FIG. 7 illustrates the drive lever 150 with the doors in open position.

The outermost upper portion of drive lever 150 has a secondary lock in the form of a hook 170 which is pivotally joined thereto by a horizontal lateral pin 172 (FIG. 3). Hook 170 is made of two spaced apart plates 178 which are maintained spaced apart by pin 174 and roller 176 which is mounted between the plates on an axle joined to the plates 178. The roller 176 is located along the bottom of hook 170 so as to project downwardly beyond the hook edge so that it can roll along the top of clevis 128 and the top of cam element 180 also located on the top of the clevis. The forward end of hook 170 has a downwardly extending nose 182 which engages with latch 184, mounted on the end of air cylinder 120, when the car doors are closed. The resulting locking arrangement prevents the car doors from opening accidentally even if the pin 74 is caused to move from over-center position to below-center position. The hook 170 is kept from being jarred out of locking position by a torsion spring 186 located on pin 172.

To open the car doors, air pressure is applied on the left side of the piston in air cylinder 120. This causes the connecting rod 126 to move outwardly a short distance equal to the lost motion clearance provided by slots 130 before any driving force is applied to drive lever 150. Any earlier application of driving force to the drive lever 150 would be restrained by the locking action of hook 170 with latch 184. The movement of the connecting rod 126 for the short distance of the lost motion causes the cam 180 to push against roller 176 and cause it to move upwardly for a height sufficient for the nose 182 to rise above the top of latch 184, thereby releasing the secondary lock. The air pressure in the cylinder continues to move the connecting rod 126 outwardly thereby causing the drive lever 150 to rotate from door closed position to door open position (FIGS. 3 and 7). As the drive lever 150 rotates it pulls on the beam assembly 50 causing each beam section 200 to move in sequential order for a distance equal to the lost motion provided in each beam section by slot 110. The unloading lading provides an assisting force to help open the doors as each beam section moves.

After the car lading has been discharged, the car doors can be closed by venting air from the left side of the piston in air cylinder 120 and applying air pressure to the right side of the piston to cause the connecting rod 126 to move into the air cylinder. As the connecting rod moves to the left as described it pulls on the drive lever and causes it to rotate counterclockwise. This causes the application of a pushing or compressive force on beam assembly 50. Each of the beam sections 200 then moves to the right sequentially for a distance equal to the lost motion of slots 110 until all the lost motion has been eliminated. Then the entire beam assembly moves in a unitary manner so that all the doors close simultaneously. As the doors move into final closed position the hook 170 is automatically guided over latch 184 and into locking position with it.

Although the invention as described above in conjunction with the drawings utilizes a third arm 62 as part of the door operating lever 54, the third arm 62 could be eliminated if it is desired to eliminate use of every other door i.e., doors 40A, 42A, 44A and 46A. Eliminating doors, however, may require that the car body be modified internally so that lading can flow out readily through the remaining doors. Furthermore, one or more of the door operating levers 54 could be entirely eliminated. In still another embodiment, one or more first arms 58 could be eliminated as well as one or more third arms 62 in the event the number of car doors included in the car is reduced, such as to two, three, four or more doors up to less than eight doors.

The foregoing detailed description has been given for clearness of understanding only, and no unnecessary limitations should be understood therefrom, as modifications will be obvious to those skilled in the art.

What is claimed is:

1. A railroad hopper car comprising:

an elongated car body having a plurality of laterally pivoted bottom discharge doors;

a door opening and closing elongated beam assembly positioned longitudinal of and along the bottom portion of the car;

a plurality of spaced apart door operating levers mounted on pivot means lateral to the car body along and to the bottom of the car;

each door operating lever having at least first and second outwardly extending arm portions;

a bar link pivotally connected at a first end to each door operating lever first arm portion and pivotally connected at a second end to one of the doors;

the second arm portion of each door operating lever being pivotally connected to the elongated beam assembly;

the second arm portions of the various levers being pivotally connected to the elongated beam assembly in spaced apart consecutive arrangement thereby defining beam sections between such pivotally connected lever arm portions;

each beam section including a longitudinal lost motion means which permits displacement of the beam section for a short distance before it can apply a force in either direction to an adjacent beam section so that it can thereby apply sequential movement and force in one direction in tension and in the opposite direction in compression; and power means mounted on the car to drive the elongated beam in longitudinally opposite directions.

2. A car according to claim 1 in which each beam assembly section has means to change its length separate from the lost motion means.

3. A car according to claim 2 in which each bar link includes means to change its length so that the door to which it is connected can be adjusted to be closed tightly.

4. A car according to claim 2 in which the means to change the length of a plurality of beam sections includes a clevis threaded into a plurality of the beam sections.

5. A car according to claim 1 in which each bar link includes means to change its length so that the door to which it is connected can be adjusted to be closed tightly.

6. A car according to claim 5 in which when the door is closed the bar link first end pivotal connection to the operating lever first arm is at an over-center position with respect to a line through the pivotal connection of the bar link second end to the door and the pivotal connection of the lever arm to the car body thereby preventing the door from opening without a dynamic force being applied by the operating lever.

7. A car according to claim 5 in which the means to change the length of a plurality of bar links includes a clevis threaded into a plurality of the bar links.

8. A car according to claim 1 in which a plurality of the door operating levers have a third outwardly extending arm; and a second bar link pivotally connected at a first end to the third arm portion and pivotally connected at a second end to one of the doors.

9. A car according to claim 8 in which each beam assembly section has means to change its length separate from the lost motion means.

10. A car according to claim 9 in which each bar link includes means to change its length so that the door to which it is connected can be adjusted to be closed tightly.

11. A car according to claim 8 in which each bar link includes means to change its length so that the door to which it is connected can be adjusted to be closed tightly.

12. A car according to claim 11 in which when the door is closed the second bar link first end pivotal connection to the operating lever third arm is at an over-center position with respect to a line through the pivotal connection of the second bar link second end to the door and the pivotal connection of the lever arm to the car body thereby preventing the door from opening without a dynamic force being applied by the operating lever.

13. A car according to claim 1 in which the lost motion means includes a pin in one portion of the beam section and a slot in an adjoining beam portion in which the pin can slide a short distance.

14. A car according to claim 1 including means to drive the beam in opposite directions to fully open and fully close all of the doors substantia11y simultaneously.

15. A car according to claim 14 in which the drive means includes:

an air cylinder mounted on the car body;

a double acting piston in the air cylinder having a connecting rod extending out of the cylinder;

a drive lever pivotally mounted at the bottom of the car body; and a first end of the drive lever being pivotally connected to the connecting rod and a second end of the drive lever being pivotally connected to the elongated beam.

* * * * *

UNITED STATES PATENT AND TRADEMARK OFFICE

CERTIFICATE OF CORRECTION

PATENT NO. : 4,766,820

DATED : August 30, 1988

INVENTOR(S) : John Albert Ritter et al

It is certified that error appears in the above-identified patent and that said Letters Patent is hereby corrected as shown below:

Column 3, line 67, change "are" to -- arm --; column 8, line 16, change "substantiaIIy" to -- substantially --.

Signed and Sealed this

Thirteenth Day of December, 1988

*Attest:*

DONALD J. QUIGG

*Attesting Officer*

*Commissioner of Patents and Trademarks*